US006978705B1

(12) United States Patent
Lee

(10) Patent No.: US 6,978,705 B1
(45) Date of Patent: Dec. 27, 2005

(54) TORQUE WRENCH

(76) Inventor: Chang Chuan Lee, No. 429, Jhongjheng Rd., Caotun Township, Nantou County 542 (TW)

( * ) Notice: Subject to any disclaimer, the term of this patent is extended or adjusted under 35 U.S.C. 154(b) by 0 days.

(21) Appl. No.: 11/001,076

(22) Filed: Dec. 2, 2004

(51) Int. Cl.[7] ..... B25B 23/14
(52) U.S. Cl. ..... 81/467; 81/478; 81/468
(58) Field of Search ..... 81/467, 478, 468, 81/472, 473, 475, 477, DIG. 5; 192/48.3

(56) References Cited

U.S. PATENT DOCUMENTS 2,797,564 A * 7/1957 Bonneau et al. ..... 464/38
3,890,859 A * 6/1975 Grabovac et al. ..... 81/474
4,063,474 A * 12/1977 Klopping ..... 81/474
4,709,602 A * 12/1987 Grabovac et al. ..... 81/483
4,870,879 A * 10/1989 Shieh ..... 81/483
5,129,293 A * 7/1992 Larson et al. ..... 81/483
5,662,012 A * 9/1997 Grabovac ..... 81/483
5,746,298 A * 5/1998 Krivec et al. ..... 192/48.3
6,155,147 A * 12/2000 Dzieman ..... 81/473
6,216,570 B1 * 4/2001 Freed ..... 81/467
6,463,834 B2 * 10/2002 Kemp et al. ..... 81/483
6,487,943 B1 * 12/2002 Jansson et al. ..... 81/475
6,722,235 B2 * 4/2004 Hsieh ..... 81/478

* cited by examiner

*Primary Examiner*—Lee D. Wilson
*Assistant Examiner*—Alvin J. Grant
(74) *Attorney, Agent, or Firm*—Rosenberg, Klein & Lee

(57) ABSTRACT

A torque wrench including a wrench main body, a central push rod mounted in the main body and having an escape section, an adjustment handle adjustably fitted with one end of the main body and a restricting member locked on the central push rod. When adjusting the preset torque value, a user engages a toothed section of the central push rod in a toothed hole of the adjustment handle; the adjustment handle drives the central push rod to adjust the torque value of the torque wrench. The toothed section of the central push rod is then disengaged from the toothed hole of the adjustment handle. The escape section having a diameter smaller than the diameter of the toothed hole fits into the toothed hole so that the central push rod is free from the adjustment handle; as a result the torque value will not be unexpectedly changed.

3 Claims, 4 Drawing Sheets

TORQUE WRENCH

BACKGROUND OF THE INVENTION

The present invention is related to an improved torque wrench in which the central push rod has an escape section. After the torque value of the torque wrench is adjusted, a toothed section of the central push rod is disengaged from a toothed hole of the adjustment handle of the torque wrench. At this time, the escape section of the central push rod gets into the toothed hole so that the central push rod is free from the adjustment handle. Accordingly, when operating the torque wrench, the central push rod will not be driven by the adjustment handle so that the torque value of the torque wrench will not be unexpectedly changed.

FIG. 1 shows a conventional adjustable torque wrench. The wrench main body 1 has a working head section 11 at one end. A central push rod 12 and an adjustment handle 13 are adjustably mounted in the other end of the wrench main body 10. A restricting member 14 is locked on the central push rod to connect one end of the central push rod 12 with the adjustment handle 13. When rotating the adjustment handle 13, the central push rod 12 is rotated along with the adjustment handle 13 so as to adjust the torque value of the torque wrench.

The conventional adjustable torque wrench has some shortcomings in use. For example, after the adjustment handle 13 is rotated to a certain torque scale relative to the wrench main body 10, the adjustment handle 13 is locked. However, in operation of the torque wrench, a user will hold the adjustment handle 13 and apply a force thereon. Under such circumstance, the torque value of the torque wrench is often unexpectedly changed. As a result, the user needs to repeatedly adjust the torque value of the torque wrench. Moreover, when applying the force onto the adjustment handle in operation, the locking structure of the adjustment handle tends to break and damage.

SUMMARY OF THE INVENTION

It is therefore a primary object of the present invention to provide an improved torque wrench in which the central push rod has an escape section. After the torque value of the torque wrench is adjusted, a toothed section of the central push rod is disengaged from a toothed hole of the adjustment handle of the torque wrench. At this time, the escape section of the central push rod having a diameter smaller than the diameter of the toothed hole gets into the toothed hole so that the central push rod is free from the adjustment handle. Accordingly, when operating the torque wrench, the central push rod will not be driven by the adjustment handle so that the torque value of the torque wrench will not be unexpectedly changed.

The present invention can be best understood through the following description and accompanying drawings wherein:

DETAILED DESCRIPTION OF THE PREFERRED EMBODIMENTS

Figure 1:
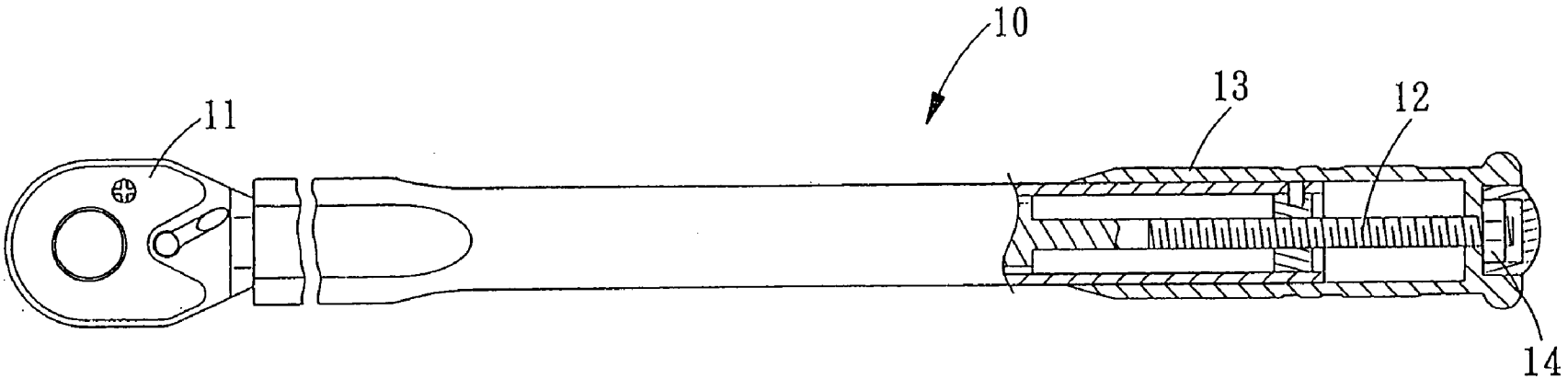
FIG. 1 PRIOR ART
FIG. 1 is a partially sectional view of a conventional adjustable torque wrench.
Figure 2:
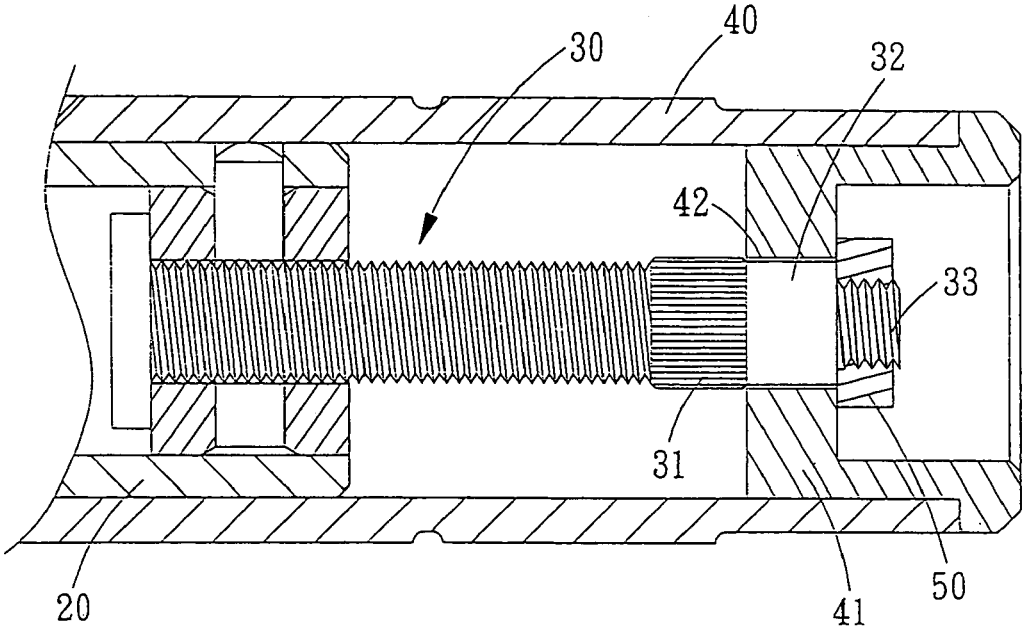
FIG. 2 is a sectional view of a part of the torque wrench of the present invention.
Figure 3:
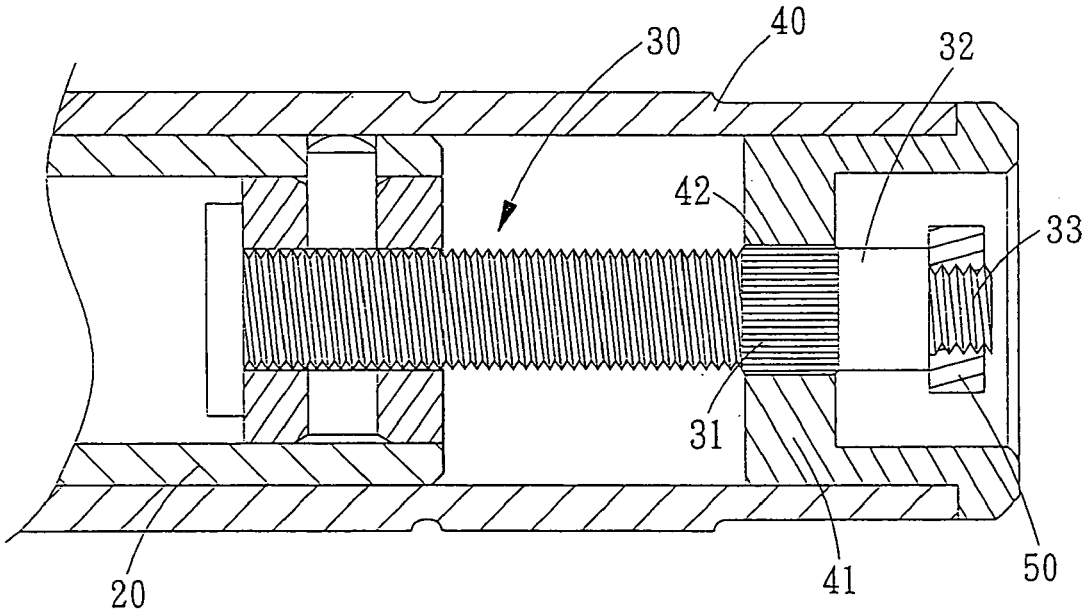
FIG. 3 is a sectional view according to FIG. 2, showing that the toothed section of the central push rod is engaged in the toothed hole of the fixing cap of the adjustment handle of the present invention.
Figure 4:
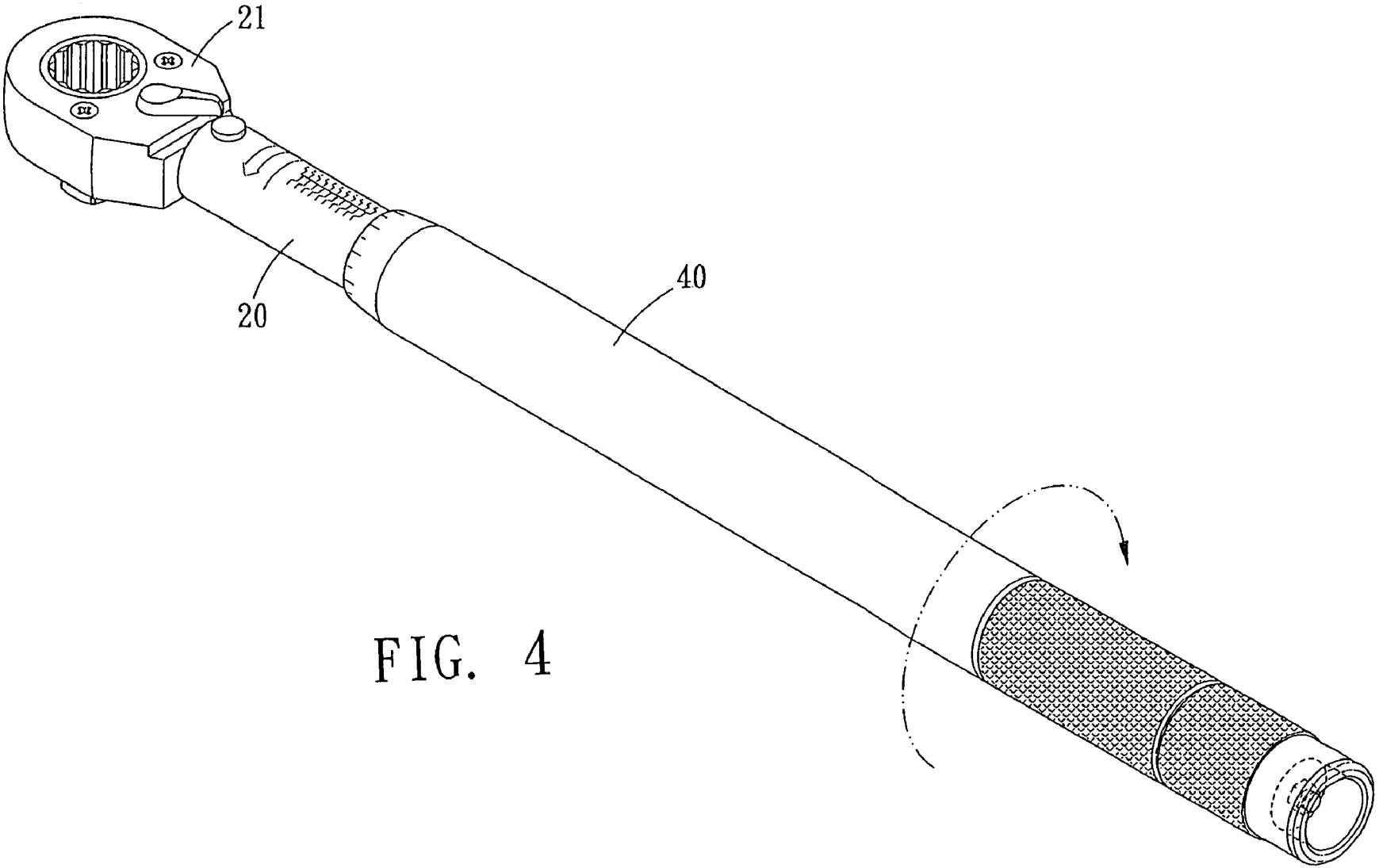
FIG. 4 is a perspective view of the torque wrench of the present invention, showing that the adjustment handle is rotated to adjust the torque value.

Please refer to FIGS. 2 to 4. The torque wrench of the present invention includes a wrench main body 20, a central push rod 30, an adjustment handle 40 and a restricting member 50.

The wrench main body 20 is a tubular body having a working head section 21 at one end.

The central push rod 30 has a toothed section 31 and an escape section 32 connected with the toothed section 31. The diameter of the escape section 32 is smaller than the diameter of the toothed section 31. The central push rod 30 further has a threaded section 33 connected with the escape section 32. The central push rod 30 is mounted in the wrench main body 20. By means of adjusting the central push rod 30, the torque value of the wrench can be adjusted. The assembly of the central push rod 30 and the wrench main body 20 pertains to prior art and will not be further described hereinafter.

A fixing cap 41 is disposed at one end of the adjustment handle 40. The fixing cap 41 is formed with a toothed hole 42. The adjustment handle 40 is adjustably mounted at one end of the wrench main body 20. The toothed section 31 of the central push rod 30 can be engaged in the toothed hole 42 of the fixing cap 41. The threaded section 33 of the central push rod 30 is exposed to outer side of the toothed hole 42. When adjusting the adjustment handle 40, the central push rod 30 is rotated along with the adjustment handle 40.

The restricting member 50 is locked on the threaded section 33 of the central push rod 30 to prevent the adjustment handle 40 from detaching from the wrench main body 20.

Referring to FIGS. 3 and 4, when it is desired to adjust the torque value of the torque wrench, a user can hold the wrench main body 20 with one hand and hold the adjustment handle 40 with the other hand and push the adjustment handle 40 toward the working head section 21 of the wrench main body 20. At this time, the toothed section 31 of the central push rod 30 is engaged in the toothed hole 42 of the fixing cap 41 of the adjustment handle 40. Under such circumstance, the adjustment handle 40 can drive the central push rod 30. Accordingly, the adjustment handle 40 can be rotated to a certain scale relative to the wrench main body 20 so as to adjust the set torque value of the torque wrench.

After the torque value of the torque wrench is set, the adjustment handle 40 is pushed in a direction away from the working head section 21 of the wrench main body 20. At this time, the toothed section 31 of the central push rod 30 is disengaged from the toothed hole 42 of the fixing cap 41 of the adjustment handle 40 and the escape section 32 of the central push rod 30 gets into the toothed hole 42 of the adjustment handle 40. The diameter of the escape section 32 is smaller than the diameter of the toothed hole 42 of the adjustment handle 40 so that the central push rod 30 is free from the adjustment handle 40. Therefore, the adjustment handle 40 is simply rotated relative to the wrench main body 20 without driving the central push rod 30. Accordingly, when operating the torque wrench, the central push rod 30 will not be rotated along with the adjustment handle 40 so that the deviation of the torque value of the torque wrench can be avoided.

Figure 5:
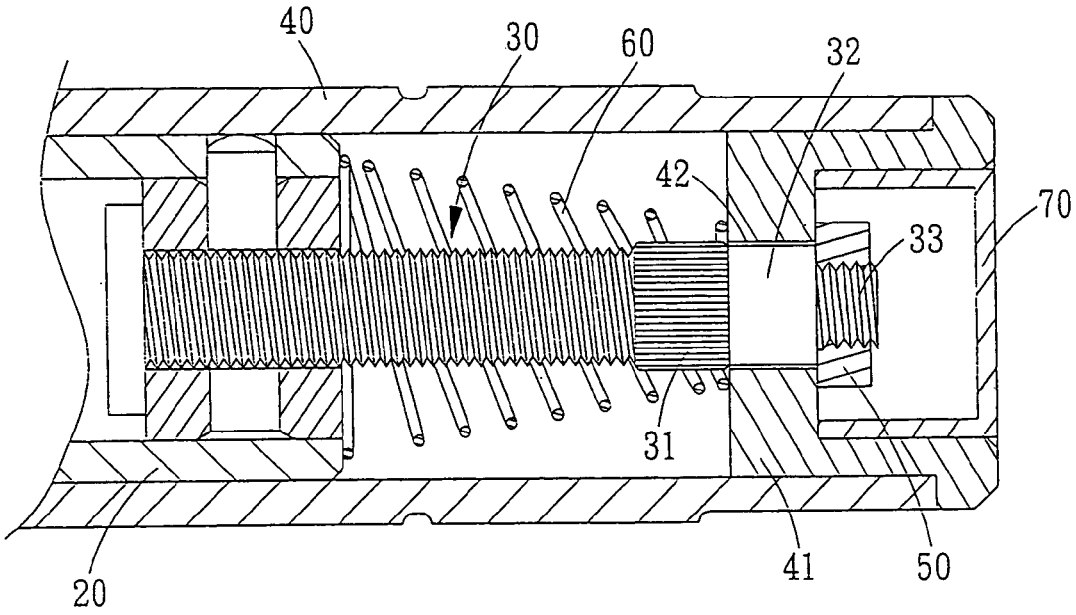
FIG. 5 is a sectional view of a part of a second embodiment of the torque wrench of the present invention.
Figure 6:
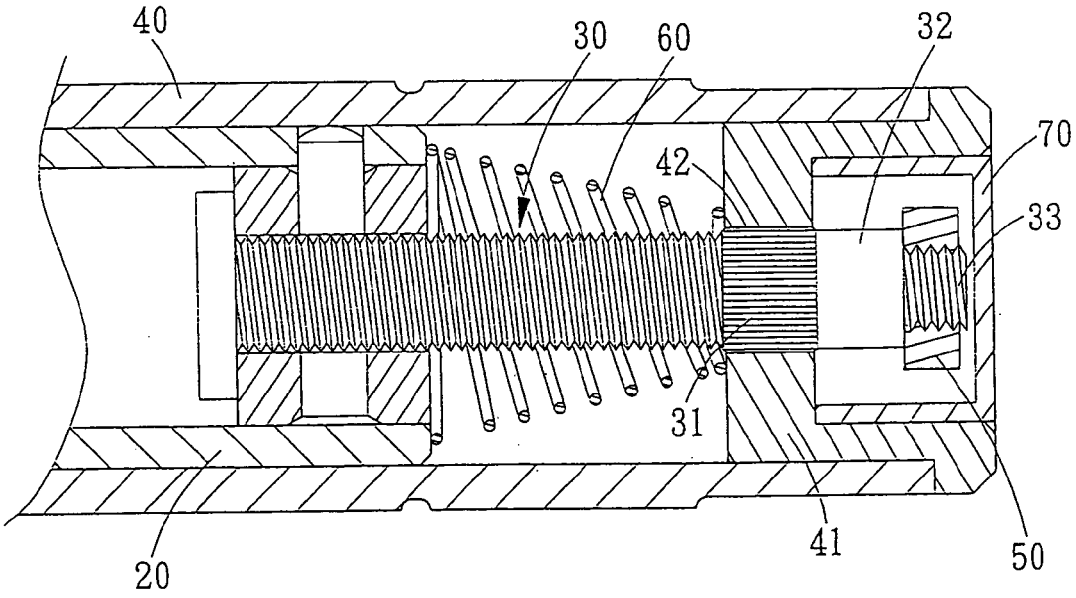
FIG. 6 is a sectional view according to FIG. 5, showing that the toothed section of the central push rod is engaged in the toothed hole of the fixing cap of the adjustment handle of the second embodiment of the present invention.

FIGS. 5 and 6 show a second embodiment of the present invention, in which a resilient member 60 is fitted on the central push rod 30. One end of the resilient member 60 abuts against one end of the wrench main body 20, while the other end of the resilient member 60 abuts against the circumference of the toothed hole 42 of the fixing cap 41 of the adjustment handle 40.

When it is desired to adjust the torque value of the torque wrench, a user pushes the adjustment handle 40 toward the working head section 21 of the wrench main body 20. At this time, the resilient member 60 is compressed by the fixing cap 41 of the adjustment handle 40 and the wrench main body 20 and the toothed section 31 of the central push rod 30 is engaged in the toothed hole 42 of the fixing cap 41 of the adjustment handle 40. Accordingly, the set torque value of the torque wrench can be adjusted and set. After the torque value of the torque wrench is set, the adjustment handle 40 is pushed by the resiliently restoring force of the resilient member 60, whereby the toothed section 31 of the central push rod 30 is quickly disengaged from the toothed hole 42 of the fixing cap 41 of the adjustment handle 40 and the escape section 32 of the central push rod 30 quickly gets into the toothed hole 42 of the adjustment handle 40. Under such circumstance, the central push rod 30 is free from the adjustment handle 40. Therefore, the adjustment handle 40 is simply rotated relative to the wrench main body 20. Accordingly, when operating the torque wrench, the central push rod 30 will not be driven and rotated by the adjustment handle 40 so that the torque value of the torque wrench will not be changed in operation of the torque wrench.

In addition, a dustproof cover 70 can be mounted at the exposed end of the adjustment handle 40 to prevent the external dusts and impurities from entering the torque wrench. Therefore, the torque wrench can be more truly and smoothly operated.

In conclusion, when it is desired to adjust the torque value of the torque wrench, a use only needs to engage the toothed section 31 of the central push rod 30 in the toothed hole 42 of the fixing cap 41 of the adjustment handle 40. Under such circumstance, the adjustment handle 40 can be rotated to drive the central push rod 30 for adjusting the set torque value of the torque wrench. After the torque value of the torque wrench is adjusted, the toothed section 31 of the central push rod 30 is disengaged from the toothed hole 42 of the fixing cap 41 of the adjustment handle 40 and the escape section 32 of the central push rod 30 gets into the toothed hole 42 of the adjustment handle 40. The diameter of the escape section 32 is smaller than the diameter of the toothed hole 42 of the adjustment handle 40 so that the central push rod 30 is free from the adjustment handle 40. Therefore, when operating the torque wrench, the central push rod 30 will not be driven and rotated by the adjustment handle 40 so that the torque value of the torque wrench will not be changed.

The above embodiments are only used to illustrate the present invention, not intended to limit the scope thereof. Many modifications of the above embodiments can be made without departing from the spirit of the present invention.

What is claimed is:

1. A torque wrench comprising a wrench main body, a central push rod, an adjustment handle and a restricting member, wherein the central push rod is mounted in the wrench main body, the central push rod having a toothed section and a threaded section, the adjustment handle being fitted with one end of the wrench main body, a fixing cap being disposed at one end of the adjustment handle, the fixing cap being formed with a toothed hole, whereby the toothed section of the central push rod can be engaged in the toothed hole of the fixing cap, the restricting member being locked on the threaded section of the central push rod, said torque wrench being characterized in that the central push rod further has an escape section between the toothed section and the threaded section, the escape section having an outer diameter smaller than a diameter of the toothed hole of the fixing cap, whereby after the torque value of the torque wrench is adjusted, the toothed section of the central push rod is disengaged from the toothed hole of the fixing cap and the escape section of the central push rod gets into the toothed hole of the fixing cap so that the central push rod is free from the adjustment handle.

2. The torque wrench as claimed in claim 1, wherein a resilient member is fitted on the central push rod, one end of the resilient member abutting against a bottom of the wrench main body, while the other end of the resilient member abutting against a top of the fixing cap, the resilient member being compressed by the fixing cap and the wrench main body, whereby after the torque value of the torque wrench is adjusted, the adjustment handle is pushed by the resiliently restoring force of the resilient member to disengage the toothed section of the central push rod from the toothed hole of the fixing cap.

3. The torque wrench as claimed in claim 1, wherein a dustproof cover is mounted at a bottom of the adjustment handle.

* * * * *